US006008472A

United States Patent [19]

Kreher et al.

[11] Patent Number: 6,008,472

[45] Date of Patent: Dec. 28, 1999

[54] ELECTRIC HEATER FOR CENTRAL BUFFER COUPLINGS

[75] Inventors: Joachim Kreher, Braunschweig; Walter Köhler, Salzgitter, both of Germany

[73] Assignee: Scharfenbergkupplung GmbH & Co. KG., Germany

[21] Appl. No.: 08/882,186

[22] Filed: Jun. 25, 1997

[30] Foreign Application Priority Data

Jun. 26, 1996 [DE] Germany ..... 296 11 148 U

[51] Int. Cl.[6] ..... B60L 1/02

[52] U.S. Cl. ..... 219/202; 219/542

[58] Field of Search ..... 219/200, 201, 219/202, 205, 206, 207, 538, 542, 543, 544

[56] References Cited

U.S. PATENT DOCUMENTS

| | | | |
|---|---|---|---|
| 2,161,724 | 6/1939 | Scharfenberg . | |
| 3,959,622 | 5/1976 | Bogdanov et al. | 219/549 |
| 4,304,975 | 12/1981 | Lenk et al. | 219/635 |
| 4,375,857 | 3/1983 | Günther et al. . | |
| 4,387,291 | 6/1983 | Keppel | 219/206 |
| 4,600,825 | 7/1986 | Blazejovsky | 219/206 |
| 4,644,316 | 2/1987 | Takeuchi et al. | 219/544 |

FOREIGN PATENT DOCUMENTS

| | | |
|---|---|---|
| 0 011 181 A1 | 5/1980 | European Pat. Off. . |
| 39 34 393 A1 | 4/1991 | Germany . |

*Primary Examiner*—Tu Ba Hoang
*Attorney, Agent, or Firm*—McGlew and Tuttle, P.C.

[57] ABSTRACT

An electric heater for central buffer couplings, with a heating element introduced into a groove of the coupling head. The heating element is covered to the outside. To reduce damage to the heating elements and to prolong the service life of the heater, the heating element in the groove is filled with silicone material, which forms the outer cover and is a flowable single-component material, which undergoes crosslinking at room temperature under the action of atmospheric humidity.

14 Claims, 1 Drawing Sheet

ELECTRIC HEATER FOR CENTRAL BUFFER COUPLINGS

FIELD OF THE INVENTION

The present invention pertains to an electric heater for central buffer couplings, whose heating element is introduced into a groove of the coupling head and is covered to the outside.

BACKGROUND OF THE INVENTION

Central buffer couplings of the Scharfenberg design have been known, in which an approximately semicircular groove, into which a heating element is placed, is provided in the buffer surface of the coupling head in the area of the centering cone and of the funnel. The heating element shall keep the front faces and the coupling mechanism free from ice and snow in the winter and ensure the function of the coupling. The groove is closed to the outside by a hard solder, which forms part of the buffer surface. Only low-melting hard solders, e.g., expensive silver filler, can be used as hard solders, because there is a risk of damage to the heating element at higher processing temperatures.

The use of soft solders with lower melting point proved to be unsuitable, because the melting point of the soft solder was frequently reached at the required heat output of the heating element.

It has also been known that the groove can be closed to the outside by welded-in cover plates. The possible warping of the cover plates as well as of the front plate due to the increased supply of heat during welding must be borne in mind and taken into account. Uneconomical preparatory procedures of the groove with ground contact for the cover plate and uneconomical finishing operations, especially the leveling of the weld seam, are necessary. Besides the possible damage to the heating element due to the welding process, there always is a risk of penetration of moisture into the cavity and consequently of damage to the heating element.

SUMMARY AND OBJECTS OF THE INVENTION

The primary object of the present invention is therefore to improve an electric heater for central buffer couplings and/or a method of providing such a heater wherein the manufacture and assembly are economical and simple, and damage to the heater will be reduced and the service life of the heater will be prolonged.

According to the invention, an electric heater for central buffer couplings is provided, with a heating element which is introduced/provided into/in a groove of the coupling head and is covered to the outside. The heating element is held in the groove with a silicone material. The groove is filled with the silicone material and forms the outer cover. The silicone material is a flowable single-component material that undergoes crosslinking at room temperature under the action of atmospheric humidity.

The silicone material preferably sufficiently maintains its elasticity in the temperature range from at least −40° C. to at least +200° C. The silicone material preferably has good electric insulation (dielectric strength greater than or equal to 12 kV/mm) at good thermal conductivity.

The central buffer coupling may be an automatic buffer coupling as is known from U.S. Pat. No. 4,375,857 (which is hereby incorporated by reference) but with the heating arrangement as described herein. The coupling concepts on which these automatic buffer couplings are based is discussed in U.S. Pat. No. 2,161,724 (which is hereby incorporated by reference).

The various features of the novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
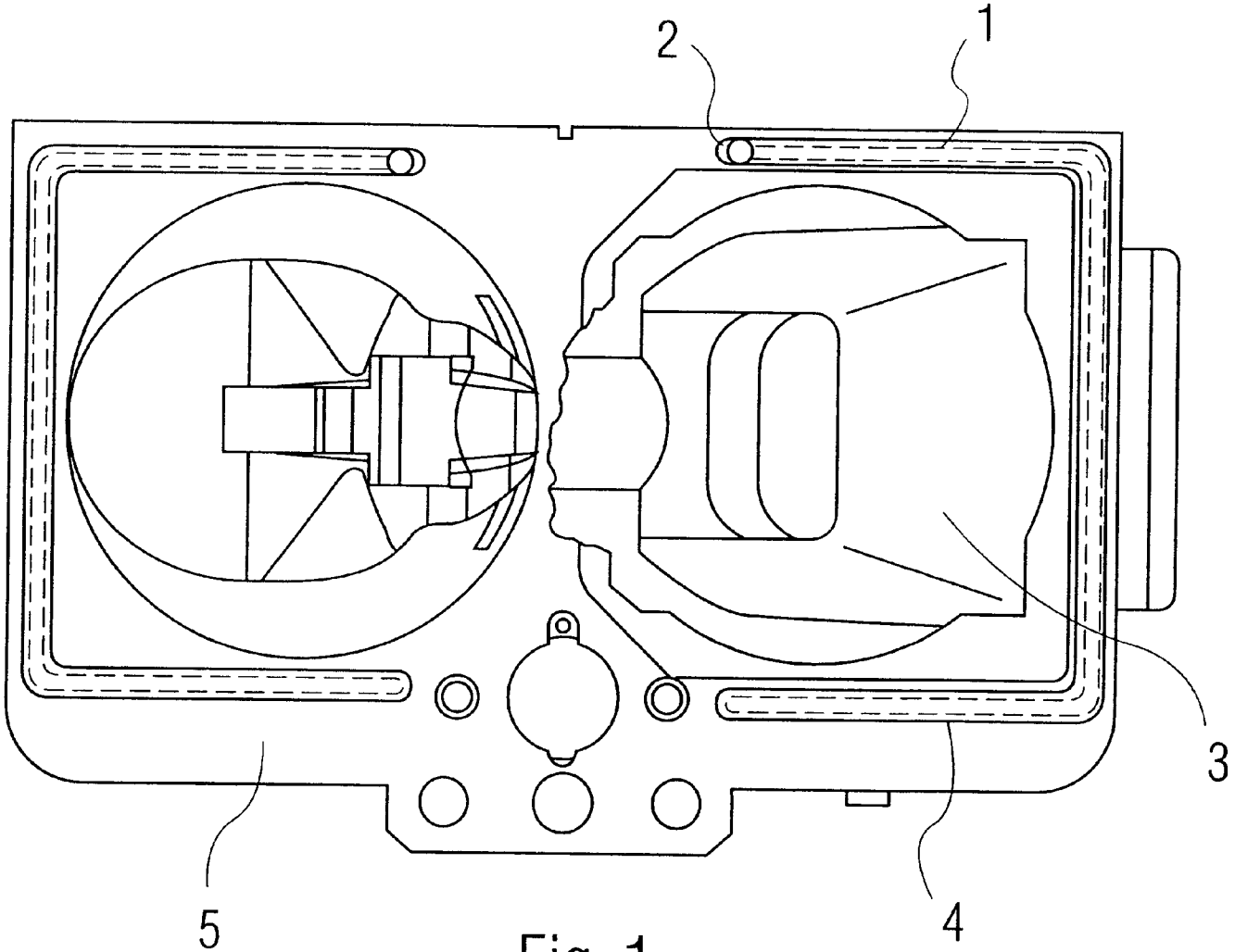
FIG. 1 is an electric heater for a central buffer coupling with heating element introduced into the heater.

Referring to the only drawing in particular, the present invention comprises an electric heater for central buffer couplings and a method of forming the buffer coupling with heater. The method includes introducing a heating element 1 of the heater into a groove 2 of a coupling head 3 and is covered to the outside. To reduce damage to the heating elements 1 and to prolong the service life of the heater, the heating element 1 in the groove 2 is filled with silicone material 4, which forms the outer cover. This silicone material 4 is a flowable single-component material, which undergoes crosslinking at room temperature under the action of atmospheric humidity.

The electric heater according to the present invention for a central buffer coupling includes the heating element 1, which is provided in the groove 2 of the coupling head 3. The heating element 1 is disposed in the groove 2 and is held in the groove by means of the elastic adhesive sealant. The adhesive sealant used is the silicone material 4. The groove 2 filled with the silicone material 4 completely up to the edge of the buffer surfaces forms a closure, with the outer surface of the material 4 being the outer closure of the groove 2 or the outer cover of the coupling head heater arrangement.

The silicone material 4 is a flowable single-component material at room temperature, which is crosslinked or undergoes elastic curing at room temperature under the action of atmospheric humidity.

The silicone material is designed to be such that it sufficiently maintains its elasticity in the temperature range from at least −40° C. to at least +200° C.

The silicone material used is also characterized by a good electrical insulation with a dielectric strength greater than or equaling 12 kiloVolt per mm (kV/mm) at good thermal conductivity.

While a specific embodiment of the invention has been shown and described in detail to illustrate the application of the principles of the invention, it will be understood that the invention may be embodied otherwise without departing from such principles.

What is claimed is:

1. A central buffer coupling electric heater, comprising:

a coupling head with a portion defining a groove, said coupling head includes coupling means for connecting to another coupling head of another vehicle;

a heating element disposed in said groove, said heating element having an outwardly directed side;

a silicone material forming an outer cover, covering said heating element on said outwardly directed side, said silicone material holding said heating element in said groove, said groove being substantially filled with silicone material and forming said outer cover, said silicone material being a flowable single-component material that undergoes crosslinking at room temperature under the action of atmospheric humidity.

2. The electric heater in accordance with claim 1, wherein said silicone material sufficiently maintains its elasticity in the temperature range from at least −40° C. to at least +200° C.

3. The electric heater in accordance with claim 1, wherein said silicone material has electric insulation with a dielectric strength greater than or equal to 12 kV/mm and thermal conductivity.

4. The electric heater in accordance with claim 2, wherein said silicone material has electric insulation with a dielectric strength greater than or equal to 12 kV/mm and thermal conductivity.

5. The electric heater in accordance with claim 1, wherein said silicone material has dielectric strength greater than or equal to 12 kV/mm at good thermal conductivity.

6. A central buffer coupling for coupling vehicles, the coupling formed by the steps comprising:

providing a coupling head with a portion defining a groove, said coupling head includes coupling means for connecting to another coupling head of another vehicle;

introducing a heating element into said groove, said heating element having an outwardly directed side;

filling the groove with a silicone material and covering said heating element on said outwardly directed side to form an outer cover, said silicone material holding said heating element in said groove, said silicone material being a flowable single-component material, said flowable material undergoing crosslinking at room temperature under the action of atmospheric humidity after filling the groove and covering the heating element.

7. The central buffer coupling in accordance with claim 6, wherein said silicone material sufficiently maintains its elasticity in the temperature range from at least −40° C. to at least +200° C.

8. The central buffer coupling in accordance with claim 6, wherein said silicone material has electric insulation with a dielectric strength greater than or equal to 12 kV/mm and thermal conductivity.

9. A method of forming a central buffer coupling for coupling vehicles, the method comprising the steps of:

forming a coupling head with a portion defining a groove, said coupling head including coupling means for connecting with another coupling head of another vehicle;

introducing a heating element into said groove, said heating element having an outwardly directed side;

filling the grove with a silicone material and covering said heating element on said outwardly directed side to form an outer cover, said silicone material holding said heating element in said groove, said silicone material being a flowable single-component material;

curing the flowable material whereby the material undergoing crosslinking at room temperature under the action of atmospheric humidity after filling the groove and covering the heating element.

10. The method in accordance with claim 9, wherein said silicone material sufficiently maintains its elasticity in the temperature range from at least −40° C. to at least +200° C.

11. The method in accordance with claim 9, wherein said silicone material has electric insulation with a dielectric strength greater than or equal to 12 kV/mm and thermal conductivity.

12. The method in accordance with claim 9, wherein:

said coupling means is for an automatic railway controlled buffer coupling of two railroad vehicles.

13. The electric heater in accordance with claim 1, wherein:

said coupling means is for an automatic railway controlled buffer coupling of two railroad vehicles.

14. The central buffer coupling in accordance with claim 6, wherein:

said coupling means is for an automatic railway controlled buffer coupling of two railroad vehicles.

* * * * *